US012146381B2

(12) United States Patent
Ramasamy et al.

(10) Patent No.: US 12,146,381 B2
(45) Date of Patent: Nov. 19, 2024

(54) DRILLING STABILIZERS WITH DISSOLVABLE WINDOWS FOR CONTROLLED RELEASE OF CHEMICALS

(71) Applicant: SAUDI ARABIAN OIL COMPANY, Dhahran (SA)

(72) Inventors: Jothibasu Ramasamy, Dhahran (SA); Chinthaka Pasan Gooneratne, Dhahran (SA); Jianhui Xu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/497,569

(22) Filed: Oct. 30, 2023

(65) Prior Publication Data

US 2024/0060388 A1 Feb. 22, 2024

Related U.S. Application Data

(62) Division of application No. 17/541,808, filed on Dec. 3, 2021, now Pat. No. 11,851,977.

(51) Int. Cl.

| | |
|---|---|
| ***E21B 33/134*** | (2006.01) |
| ***E21B 17/10*** | (2006.01) |
| ***E21B 29/02*** | (2006.01) |
| ***E21B 33/138*** | (2006.01) |
| *E21B 21/00* | (2006.01) |

(52) U.S. Cl.

CPC ..... *E21B 33/134* (2013.01); *E21B 17/1078* (2013.01); *E21B 29/02* (2013.01); *E21B 33/138* (2013.01); *E21B 21/003* (2013.01); *E21B 2200/08* (2020.05)

(58) Field of Classification Search

CPC ..... C09K 8/605; C09K 8/68; C09K 8/035; C09K 8/805; C09K 2208/12; C09K 8/62; C09K 8/665; C09K 2208/32; C09K 2208/26; E21B 47/13; E21B 43/26; E21B 23/00; E21B 43/267; E21B 47/12; E21B 33/1208; E21B 33/1285; E21B 33/134; E21B 33/138; E21B 29/02; E21B 17/1078; E21B 21/003; E21B 2200/08; E21B 23/06; E21B 41/02

See application file for complete search history.

(56) References Cited

U.S. PATENT DOCUMENTS

| | | | |
|---|---|---|---|
| 5,697,442 | A | 12/1997 | Baldridge |
| 6,302,201 | B1 | 10/2001 | Elliott |

(Continued)

FOREIGN PATENT DOCUMENTS

| | | | | |
|---|---|---|---|---|
| CA | 2697210 A1 | | 9/2010 | |
| CA | 2677345 C | * | 1/2013 | ..... E21B 17/1042 |

(Continued)

*Primary Examiner* — Zakiya W Bates

(74) *Attorney, Agent, or Firm* — Bracewell LLP; Constance G. Rhebergen; Eleanor T. Porter

(57) ABSTRACT

Apparatuses, systems, and methods of use are provided for a drilling stabilizer with chemical compartments within the teeth of the drilling stabilizer. The drilling stabilizer features dissolvable windows that allow chemicals to flow from the chemical compartments into the wellbore. The chemicals released can include cross-linkers or activators, which can react with polymers downhole to generate a plug for fluid loss control.

6 Claims, 4 Drawing Sheets

(56) References Cited

U.S. PATENT DOCUMENTS

| | | | |
|---|---|---|---|
| 7,191,830 | B2 | 3/2007 | McVay et al. |
| 7,303,016 | B2 | 12/2007 | Kristiansen |
| 7,493,956 | B2 | 2/2009 | Shaw et al. |
| 10,662,728 | B2 | 5/2020 | Hajji et al. |
| 10,669,789 | B2 | 6/2020 | Budler et al. |
| 10,837,260 | B2 | 11/2020 | Mcclean et al. |
| 2015/0047842 | A1 | 2/2015 | Hoskins |
| 2019/0323311 | A1 | 10/2019 | Al-Qasim et al. |

FOREIGN PATENT DOCUMENTS

| | | | |
|---|---|---|---|
| CA | 2500520 | C | 3/2013 |
| GB | 2474780 | A | 4/2011 |
| WO | 2012154473 | A1 | 11/2012 |
| WO | 2016043979 | A1 | 3/2016 |

* cited by examiner

DRILLING STABILIZERS WITH DISSOLVABLE WINDOWS FOR CONTROLLED RELEASE OF CHEMICALS

PRIORITY

The present application is a divisional application of and claims priority to and the benefit of U.S. patent application Ser. No. 17/541,808, filed on Dec. 3, 2021, the entire disclosure of which is incorporated here by reference.

FIELD

This disclosure relates to apparatuses, systems, and methods for downhole treatments. More specifically, this disclosure relates to a drilling stabilizer with chemical storage compartments featuring dissolvable components capable of releasing chemicals downhole.

BACKGROUND

Drilling fluid loss is a problem frequently encountered downhole, and conventional mitigation techniques can be inefficient, time consuming, uneconomical, and imprecise. Convention mitigation techniques can also result in unfortunate consequences, sometimes unforeseen at the time of the mitigation. When unacceptable drilling fluid losses are encountered, conventional lost circulation technologies are deployed into the drilling fluid from the surface. Loss mitigation chemicals are introduced into the drilling fluid, and is pumped downhole as part of the standard well circulation system. The modified drilling fluid passes through the bottom hole assembly (BHA), which include a drill bit, or bypasses the BHA through a circulation port. The modified drilling fluid is ultimately designed to plug the exposed formation at a location in the wellbore in which losses are occurring. Once sealing of the wellbore has occurred and acceptable fluid loss control is established, drilling operations may resume. Conventional lost circulation material (LCM) may seal uniformly-shaped formation voids (for example, widths) up to approximately 4-6 millimeters (mm), but are often unsuccessful at effectively sealing un-uniform and larger voids. Effective sealing is often both challenging and costly. Sealing and plugging in case of fractures, voids, or vugs that have widths of more than 5 mm are often challenging. The complications and challenges increase multifold if the fractures, voids, or vugs are interconnected since the LCM has no barrier in order to form a bridge and plug. Due to these complications, often the hole must be side tracked, resulting in costly delays and lost production.

One of the effective ways to seal or plug large fractures, voids, and vugs with no barrier to form a bridge for conventional LCM is to utilize chemicals or materials that undergo instantaneous reaction and create a plug by right angle set. In this method, there is no need for a barrier for the bridge to form as the chemicals or materials set instantaneously to form a set plug. The materials can be selected to result in chemical reactions that suit the requirements of the operation. Forming a set resin plug can be performed by reacting epoxides and amine cross linkers. The hardening time depends on epoxide-amine ratio, temperature, and other conditions. Another method to create a plug is to introduce two different chemicals at the zone of interest in order to induce a reaction to form a set plug. The limitations of above mentioned two chemical methods to address severe loss circulation include pre-mature setting, not setting at the right zone, inability of predicting the exact temperature of the loss zone, and the inability of mixing two chemicals right at the loss zone to form a plug. Thus, the chemical methods to cure losses downhole are not practical for use in a well, even though the theoretical chemistry is proven to be effective. Advanced placement methods and systems for the chemical compounds that could be used to generate plugs and resolve these defects are therefore desirous.

SUMMARY

The disclosure relates to apparatuses, systems, and methods for placing chemicals downhole. A modified drilling stabilizer with chemical compartments within the stabilizer teeth is disclosed herein. The chemical compartments are sealed with windows containing a dissolvable component. As used herein the term dissolvable includes dissolving from a solid into a fluid or into smaller particulates, or degrading to the point of structural failure. The dissolvable component can be a dissolvable polymer or a dissolvable metal. As the windows dissolve, the chemicals are released into the wellbore. The chemicals can include cross-linkers or activators, which can react with polymer injected, released, introduced, or otherwise present in the wellbore. The reaction between the polymer and the cross-linkers or activators can generate a plug in the wellbore to seal off voids, including fractures and vugs, in a target area of the wellbore. The chemicals released can be used to alter the downhole wellbore fluid.

Therefore, disclosed herein is a method for performing a downhole operation requiring a release of chemicals downhole. The method includes the step of inserting a drilling stabilizer into a target area of a wellbore. The wellbore has a wellbore environment. The drilling stabilizer includes a stabilizer body and stabilizer teeth protruding from the stabilizer body. The stabilizer teeth include a chemical compartment and a compartment opening. The chemical compartment is operable to hold a first chemical composition, and the compartment opening is an aperture operable to allow the first chemical composition to move into and out of the chemical compartment. The drilling stabilizer apparatus also include a window, the window overlaying the compartment opening. The window temporarily seals the compartment opening so that the first chemical composition is prevented from being released from the chemical compartment. The window includes a dissolvable component. The method further includes the steps of dissolving the windows, and releasing the first chemical composition into the wellbore. In some embodiments, the first chemical composition includes a triggering media to trigger dissolution of the dissolvable component. In other embodiments, the dissolvable component is operable to dissolve within the wellbore environment in the absence of injecting a triggering media into the wellbore. In yet other embodiments, the method includes the step of injecting a triggering media into the wellbore, the triggering media operable to dissolve the dissolvable component of the window.

In some embodiments, the method also includes the step of injecting a space fluid into the wellbore. The spacer fluid includes a triggering media, where the triggering media is operable to dissolve the dissolvable component of the window. In some embodiments, the method includes the step of reacting the first chemical composition with a second chemical composition to form a plug in the target area of the wellbore. The plug seals off voids in the target area, either in the formation or in the wellbore. Voids include fractures, vugs, and other void-like spaces. In some embodiments, the second chemical composition is present in the wellbore environment. In other embodiments, the method includes the step of injecting the second chemical composition into the wellbore. In some embodiments, a spacer fluid comprises the second chemical composition.

In some embodiments, the stabilizer teeth include a first stabilizer tooth and a second stabilizer tooth. The first stabilizer tooth includes a first chemical compartment and a first window. The second stabilizer tooth includes a second chemical compartment and a second window. The first chemical compartment is operable to hold the first chemical composition, and the second chemical compartment is operable to hold the second chemical composition. The method includes the steps of dissolving the first window of the first chemical compartment, releasing the first chemical composition from the first chemical compartment, dissolving the second window of the second chemical compartment, and releasing the second chemical composition from the second chemical compartment. In some embodiments, the first chemical composition includes a triggering media operable to dissolve the second window. The first chemical composition includes a component selected from the group consisting of an activator, a cross-linker, and combinations of the same; and the second chemical includes a polymer. The plug is drillable.

Further disclosed herein is a drilling stabilizer apparatus for use downhole. The drilling stabilizer apparatus includes a stabilizer body and stabilizer teeth protruding from the stabilizer body. At least one stabilizer tooth includes a chemical compartment and a compartment opening. The chemical compartment is operable to hold a chemical, and the compartment opening is an aperture operable to allow the chemicals to move into and out of the chemical compartment. The drilling stabilizer apparatus also include a window, the window overlaying the compartment opening. The window is operable to temporarily seal the compartment opening so that the chemicals are prevented from being released from the chemical compartment. The window includes a dissolvable component. In some embodiments, the stabilizer teeth are hollow defining the chemical compartment. In some embodiments, the window includes a dissolvable metal as the dissolvable component. The dissolvable metal is selected from the group consisting of a magnesium-based alloy, an aluminum-based alloy, and combinations of the same. In some embodiments, the window includes a dissolvable polymer as the dissolvable component. The dissolvable metal is selected from the group consisting of polyglycolic acid, polylactic acid, poly(lactide-co-glycolide) polymer, polyanhydride, poly(propylene fumarate), polycaprolactone, polyethylene glycol, polyurethane, and combinations of the same.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the scope as it can admit to other equally effective embodiments.

Figure 1A:
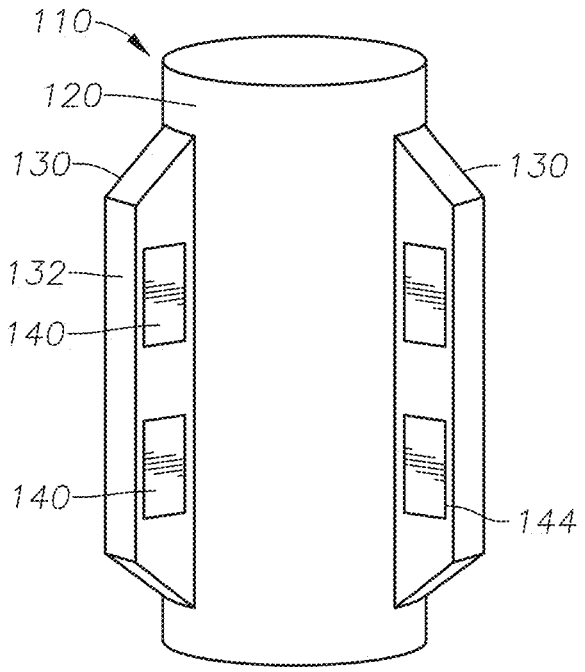
FIG. 1A is a depiction of a drilling stabilizer with dissolvable windows, according to an embodiment.

In the accompanying FIGURES, similar components or features, or both, can have a similar reference label. For the purpose of the simplified schematic illustrations and descriptions of FIGS. 1A through 3B, the numerous temperature and pressure sensors, controllers, and the like that can be employed and well known to those of ordinary skill in the art are not included. Further, accompanying components that are in conventional industrial operations are not depicted. However, operational components, such as those described in the present disclosure, can be added to the embodiments described in this disclosure.

DETAILED DESCRIPTION

While the disclosure will be described with several embodiments, it is understood that one of ordinary skill in the relevant art will appreciate that many examples, variations and alterations to the systems and methods described are within the scope and spirit of the disclosure. Accordingly, the embodiments of the disclosure described are set forth without any loss of generality, and without imposing limitations, on the claims.

Advantageously, the present disclosure allows for precisely located, on-demand delivery of chemicals downhole. The present disclosure allows for accurate delivery of chemicals to a specific target area or loss zone of the wellbore. The location of the chemical compartments close to the drill bit advantageously places the chemicals as close as possible to the bottomhole, and close to the lost circulation zone. The placement of the chemicals can be altered with the direction of travel of the drilling fluid if needed. The release of the chemicals can perform a variety of functions. In some embodiments, the chemicals released can include activators or cross-linkers which, when reacted with polymers, can generate plugs by right angle set. Advantageously, since the activators or cross-linkers and polymers react nearly instantaneously, the plug can be used to block even large fractures, voids, and vugs, or those which are interconnected within the formation. The chemical delivery system disclose herein prevents premature setting or setting at the wrong area. Additionally, if chemicals are chosen that are not temperature sensitive, there is no need to discern the exact temperature of the loss zone. Additionally, since the chemicals are shielded from the wellbore environment until released at the location, chemicals can be utilized that otherwise could not have been easily transported or pumped downhole, or that would have reacted prior to proper placement. The placement of the chemicals and any resulting reactions can occur irrespective of the downhole environment, including temperature, pH, pressure, wellbore depth, or downhole fluid composition. Due to the precise placement of the chemicals, and its physical proximity to the downhole assembly, the chance of setting the plug in the wrong area is severely reduced. Also advantageously the windows can be made of dissolvable components which can be selected or designed to be dissolved in specific environments or within a specific period of time, allowing for delay of chemical release or scheduled release downhole.

In some embodiments, the release of the chemicals is triggered by the injection of a triggering media, which triggers dissolution of the dissolvable components. In other embodiments, the release of the chemicals is passive, with an absence of intervention from the surface or other trigger from downhole. In yet other embodiments, a weighted pill or spacer within the chemical compartments assists in pushing the chemicals out of the chemical compartments and into the well bore. Mechanical actuation of downhole devices can be complicated and complex. The lack of mechanical mechanisms used for the release of the chemicals advantageously simplifies the design, prevents the potential breakdown or malfunctions of mechanical parts, reduces wear and tear, reduces opportunities for downhole failures or problems, reduces complexity, and makes the device less prone to fatigue and failure. Additionally, there is no need for control mechanisms from the surface, circumventing yet another potential avenue of failure. Advantageously, the drilling stabilizer can be fit with multiple chemical compartments with different chemicals in each of the compartments, allowing for timed, staggered, or sequenced release of chemicals and subsequent downhole reactions.

The apparatus, system, and methods disclosed herein allow for the specific placement of chemicals in the wellbore. The chemicals can be specifically selected to form a set plug. The chemicals can be selected to undergo a near-instantaneous reaction and right angle set to form a plug or set mass. The chemicals can also be selected to adjust the property of the downhole fluid or the fluid in the drilling pipe annulus. Additional applications include altering downhole fluid to become a Hi-Vis pill by having agglomerating agents and cross linkers; altering downhole fluid to become a spotting fluid by utilizing chemicals that generate exothermic reactions; altering high density downhole fluid to low density downhole fluid by including gas generating agents; and altering downhole fluid to lubricous fluid by adding lubricants.

Figure 1B:
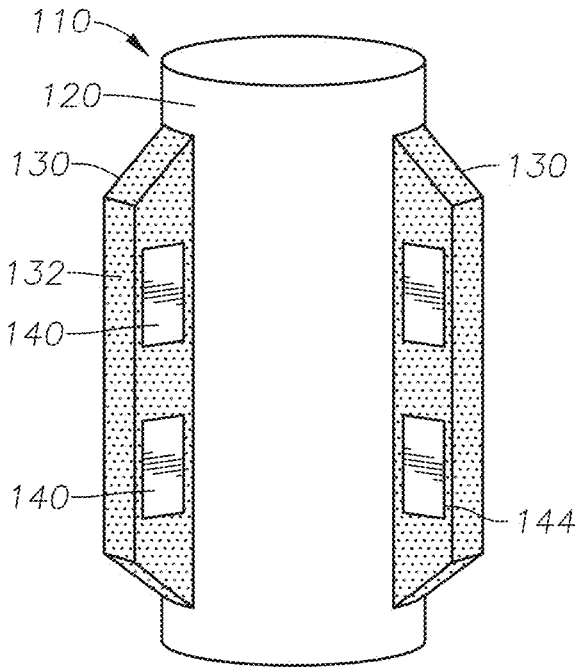
FIG. 1B is another depiction of a drilling stabilizer with dissolvable windows, according to an embodiment.
Figure 1C:
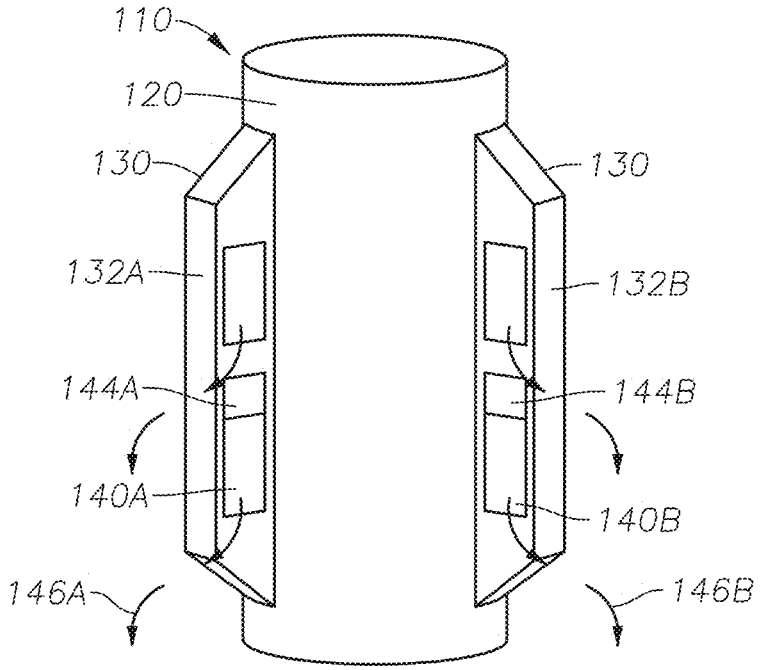
FIG. 1C is a depiction of a drilling stabilizer with dissolvable windows releasing chemicals, according to an embodiment.

Referring to FIGS. 1A-1C, drilling stabilizer 110 is depicted. Drilling stabilizer 110 includes stabilizer body 120 and stabilizer teeth 130. Stabilizer teeth 130 are fin-like projections protruding from the curved sides of the cylindrical body of the stabilizer body 120. Stabilizer teeth 130 can have other shapes or configurations. Stabilizer teeth 130 include at least one or more chemical compartments 132 and windows 140. Multiple chemical compartments 132 can be installed in multiple stabilizer teeth 130 of drilling stabilizer 110. Chemical compartment 132 can be the hollow interior portion of stabilizer tooth 130, as shown in FIG. 1B. Chemical compartment 132 can be a cavity within stabilizer tooth 130. Multiple chemical compartments 132 can be within a single stabilizer tooth 130. Chemical compartment 132 can hold, store, or otherwise retain chemicals. The chemicals can be added to chemical compartment 132 before drilling stabilizer 110 is inserted into a wellbore. In some embodiments, the chemicals are not loaded through tubing or otherwise transported into drilling stabilizer 110 after drilling stabilizer 110 is introduced into the wellbore. In other embodiments, the chemicals can enter window 140 from the wellbore, filling chemical compartment 132; then a second chemical can be introduced into the wellbore which then reseals windows 140.

Chemical compartment 132 includes compartment opening 144. Compartment opening 144 is an aperture which allows material to flow in and out of chemical compartment 132. Window 140 overlays and covers compartment opening 144. Window 140 seals compartment opening 144 such that materials within chemical compartment 132 are prevented from exiting, and materials outside chemical compartment 132 cannot enter. Window 140 includes a dissolvable component. The dissolvable component can include the dissolvable metal or the dissolvable polymer. The dissolvable component can be dissolved downhole, exposing chemical compartment 132 to the wellbore.

The dissolvable component can be a compound that dissolves when exposed to water or oil. The dissolvable component can be a compound that dissolves when exposed to a chemical component that is already present in the wellbore, such as a component of the drilling fluid. A specific dissolvable component can be selected so that the dissolution rate is appropriate for the downhole conditions and the travel time, therefore advantageously optimizing the total time spent dissolving the dissolvable component and releasing the chemicals. A triggering media can be used to trigger the dissolution of the dissolvable component, or otherwise dissolve the dissolvable component. The triggering media can be present in the chemical composition stored within chemical compartment 132, for example, in the carrier fluid. The triggering media can be pumped into the wellbore, suspended in a spacer fluid injected downhole, pumped through the drill pipe, or otherwise introduced downhole through other methods. The triggering media can include acid or brine in varying concentrations. In some embodiments, a delaying chemical selected to delay the degradation of the dissolvable component is introduced into the wellbore to reduce the dissolution rate. In some embodiments, the triggering media is utilized to schedule the dissolution of the dissolvable component of window 140 to release chemicals into the wellbore.

If the triggering media is the brine, the concentration of the brine downhole can be increased or decreased to speed or slow, respectively, the dissolution of the material. When brine is used as the triggering media and the dissolvable metal is used as the dissolvable component, the resultant of the dissolving reaction can be a metal hydroxide power. The metal hydroxide powder can have a low dissolvability in brine and can be flushed away by the flow of the downhole fluid. If the triggering media is the acid, the concentration of the acid downhole can be increased or decreased to speed or slow, respectively, the dissolution of the material. Additionally, when the triggering media is the acid, the pH of the downhole environment can be modified to speed or slow the dissolution of the material. When acid is used as the triggering media and the dissolvable component is the dissolvable metal, the resultant of the dissolving reaction can be ions in solution.

The dissolvable metal can be any metallic based material which can be dissolved in the downhole environment. In preferred embodiments, the dissolvable metal can be a magnesium based alloy, an aluminum based alloy, or a combination of the same. The dissolvable metal can be a compound that dissolves when exposed to water or oil. The dissolvable metal can be a compound that dissolves when exposed to a chemical component that is already present in the wellbore, such as a component of the drilling fluid. The dissolvable metal can be a compound that dissolves when exposed to brine or acid. The dissolution rate of the metal alloys in the dissolvable metal depend on the wellbore environment, including downhole temperature and fluid composition, and to a lesser degree downhole pressure.

The dissolvable polymer can be any polymer which can be dissolved in the downhole environment. The dissolvable polymer can include polyglycolic acid (PGA), polylactic acid (PLA), polymers poly(lactide-co-glycolide), polyanhydride, poly(propylene fumarate), polycaprolactone (PCL), polyethylene glycol (PEG), polyurethane, and combinations of the same. The dissolvable polymer can be degraded by hydrolysis, where long chains of the polymers can be broken down to smaller polymers when exposed to water or humidity resulting in a loss of structural integrity and mechanical properties. The dissolvable polymer can be dissolved by low load or erosion. The dissolvable polymer with smaller polymer chains can dissolve to become acids, such as glycolic acid for PGA or lactic acid for PLA. The dissolution rates for the dissolvable polymers are heavily dependent on the temperature and the fluid composition.

Returning to FIGS. 1A-1C, as the dissolvable component in window 140 is dissolved to the point of failure, compartment opening 144 is revealed. Chemical 146 stored within chemical compartment 132 is released into the wellbore (not pictured). Chemical 146 can be a chemical composition containing multiple chemicals in a carrier fluid, where the chemicals perform various functions downhole. Chemical 146 can include a chemical composition that also acts as a triggering media for the dissolution of windows 140, in addition to including other chemicals that perform other functions downhole. Chemical 146 can be a chemical that can react with components in the wellbore fluids to initiate a reaction. Chemical 146 can be a pH adjuster. In some embodiments, chemical 146 can be an activator or a cross-linker, selected to react with a polymer in the wellbore to generate the plug (not pictured). The polymer can be suspended in the triggering media, pumped into the wellbore, pumped through a drillstring, suspended in a spacer fluid injected downhole, or otherwise introduced downhole through other methods. Chemical 146 can be selected to react with the polymers in the wellbore irrespective of the wellbore environment. In other embodiments, chemical 146 can be the polymer selected to react with an activator or a cross-linker in the wellbore to generate the plug (not pictured). In this embodiment, the activator or cross-linker can be suspended in the triggering media, pumped into the wellbore, pumped through a drillstring, suspended in the spacer fluid, injected downhole, or otherwise introduced downhole through other methods. Chemical 146 can be selected to react with the cross-linkers or activators in the wellbore irrespective of the wellbore environment. Polymers can include biphenol A, any polymer with an epoxy functional group, acrylic acid, and other polymer compounds known in the art suitable for these purposes. Activators or cross-linkers can include tetraethylene pentamine, diethylene tetramine, caustic soda, and other activator or cross-linking compounds known in the art suitable for these purposes. Chemical 146 can flow into the formation, filling the fractures and voids. The plug generated by the reaction of the polymers and the cross-linkers or activators is drillable.

Referring now to FIG. 1C, drilling stabilizer 110 is shown releasing chemical A 146A and chemical B 146B. Chemical compartment A 132A is separate from chemical compartment B 132B, allowing each one to hold chemical A 146A and chemical B 146B, respectively. Window A 140A covers compartment opening A 144A for chemical compartment A 132A. Window B 140B covers compartment opening B 144B for chemical compartment B 132B. Window A 140A and window B 140B can be made of the same dissolvable components, such that they dissolve at approximately the same rate or are triggered to dissolve by the same stimuli. Alternatively, window A 140A and window B 140B can be made of the different dissolvable components, such that they dissolve at different rates or are triggered to dissolve by different stimuli or triggering media. Chemical compartment A 132A can hold the triggering media used to dissolve the dissolvable component of window 140B. Advantageously, when windows 140 are made of different materials, the release of the chemicals stored in separate chemical compartments 132 can be timed or occur in a particular sequence, allowing for the cure of loss in the target area of the wellbore and formation with a number of attempts, or multiple downhole actions to occur.

When window A 140A dissolves, chemical A 146A is released through compartment opening A 144A. Chemical A 146A can include a chemical that can react with components in the wellbore fluids to initiate a reaction. Chemical A 146A can include a chemical composition with one or more chemicals. Chemical A 146A can include an activator or a cross-linker, selected to react with a polymer in the wellbore to generate a plug or a set mass (not pictured). Chemical A 146A can be selected to react with the polymers in the wellbore irrespective of the wellbore environment. Chemical A 146A can include a compound that can dissolve compartment B window 140B to release Chemical B 146B.

Chemical B 146B is released from a chemical compartment B 132B through compartment opening B 144B. Chemical B 146B can be released at the same time as Chemical A 146A. Chemical B 146B can be released after Chemical A 146A. Chemical B 146B can include a different chemical than chemical A 146A. Chemical B 146B can include a chemical composition with one or more chemicals. Chemical B 146B can be a chemical that can react with components in the wellbore fluids to initiate a different reaction than chemical A 146A. Chemical B 146B can include a polymer. In the embodiment where chemical A 146A includes a cross-linker or activator, and chemical B 146B contains a polymer, the instantaneous reaction generates a plug or a set mass within the wellbore (not pictured).

Figure 2A:
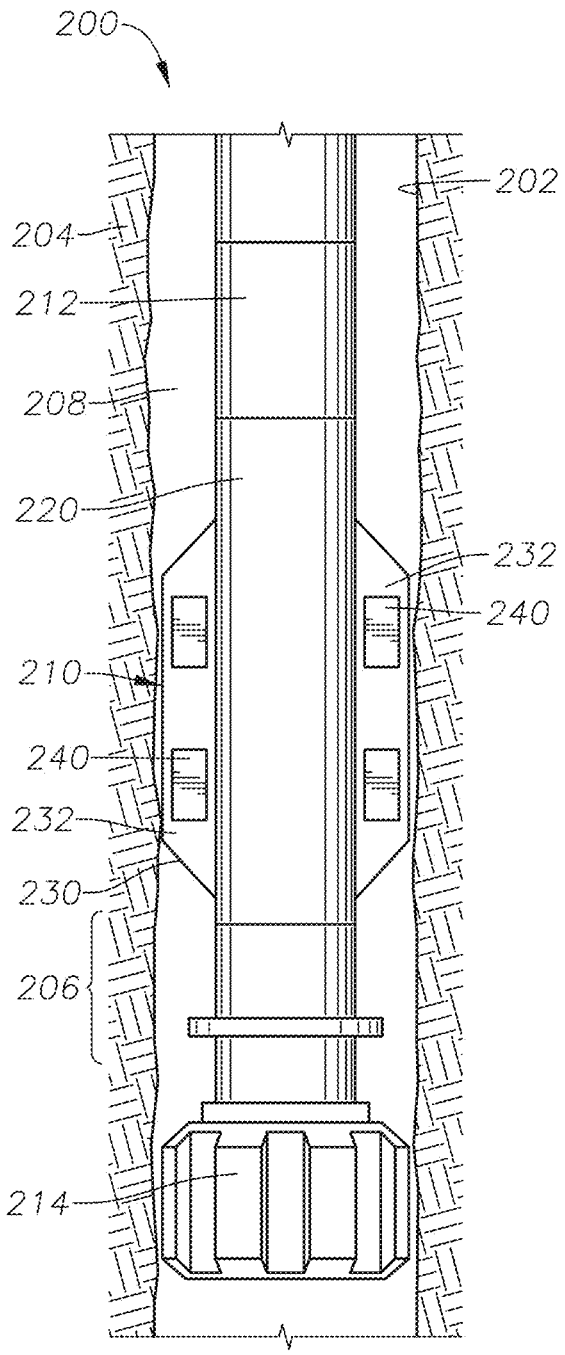
FIG. 2A is a depiction of a downhole drilling stabilizer system, according to an embodiment.
Figure 2B:
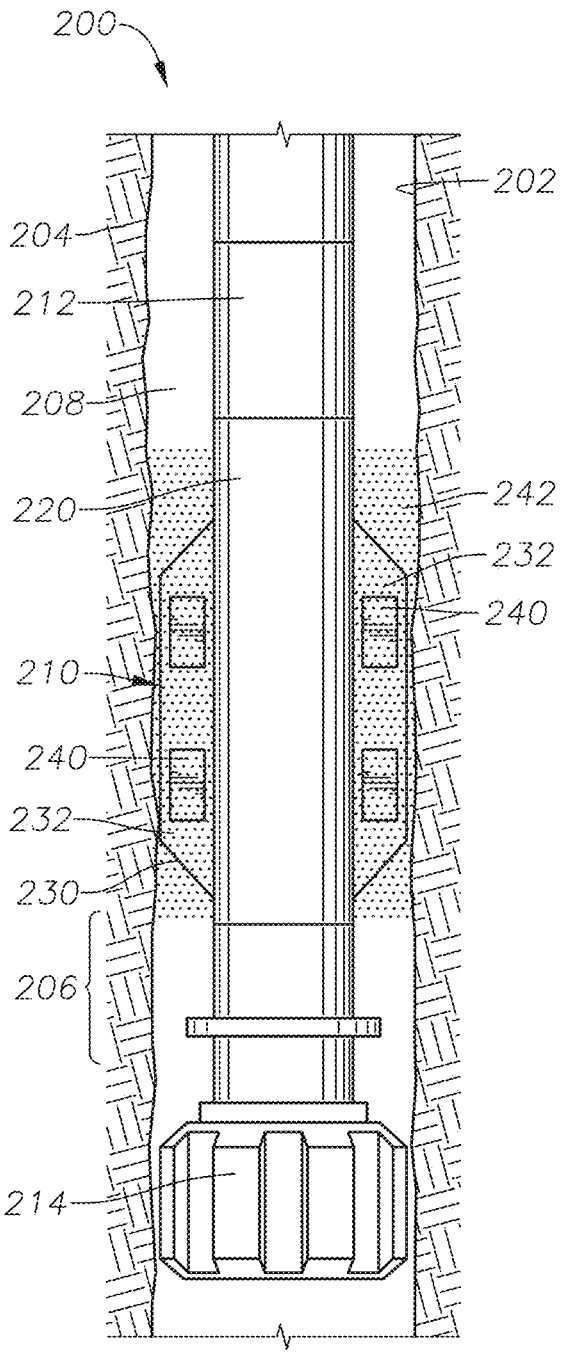
FIG. 2B is a depiction of a downhole drilling stabilizer system with a spacer fluid, according to an embodiment.
Figure 2C:
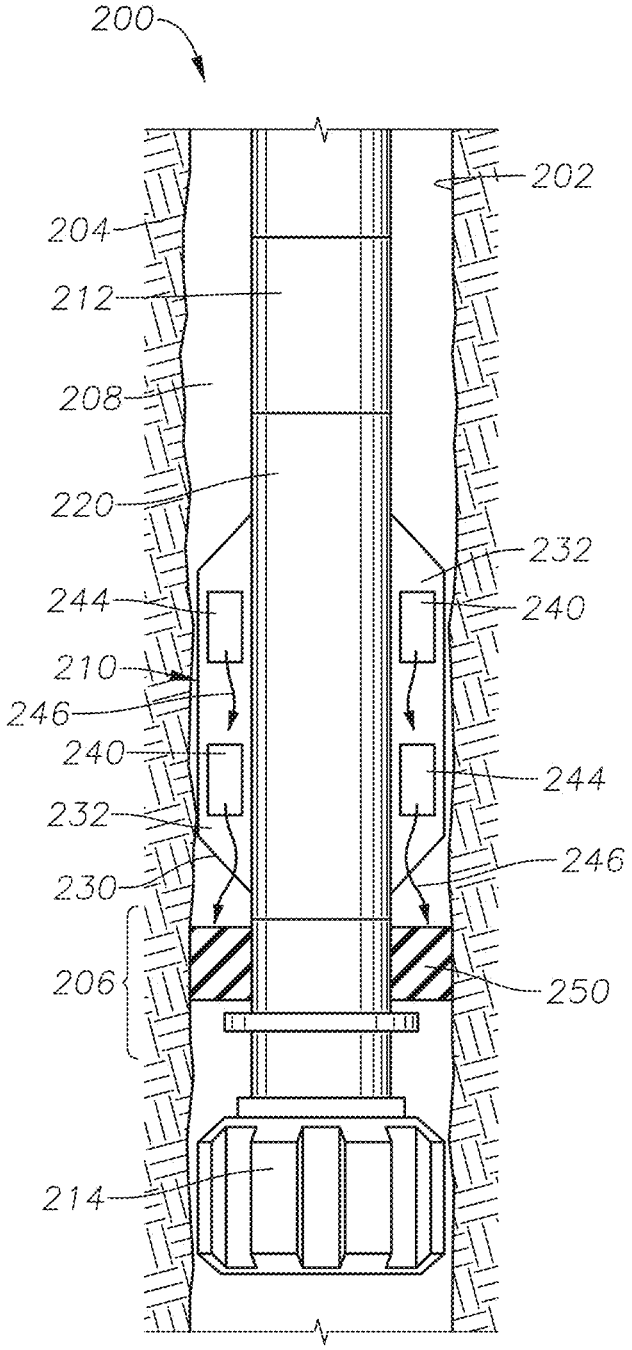
FIG. 2C is a depiction of a downhole drilling stabilizer system forming a plug, according to an embodiment.

Referring to FIGS. 2A-2C, downhole drilling stabilizer system 200 is depicted. Wellbore 202 extends through formation 204, and includes target area 206. Target area 206 is a loss zone where unacceptable drilling fluid loss is occurring. Target area 206 may feature voids, including fractures and vugs. The voids can be irregularly shaped, interconnected, or of non-uniform size. The voids can have a width of greater than 4 mm, greater than 5 mm, greater than 6 mm, or greater than 7 mm. Wellbore fluid 208 is within wellbore 202.

Drilling stabilizer 210 is attached to and lowered into wellbore 202 as a part of drillstring assembly 212. Drillstring assembly 212 includes drill bit 214. Drilling stabilizer 210 includes stabilizer body 220, stabilizer teeth 230, chemical compartments 232 within stabilizer teeth 230, and windows 240. Windows 240 can have the same or similar characteristics as windows 140. Windows 240 cover compartment openings 244. Drilling stabilizer 210 can have the same or similar features as drilling stabilizer 110. Stabilizer body 220 can have the same or similar features as stabilizer body 120. Stabilizer teeth 230 can have the same or similar characteristics as stabilizer teeth 130. Chemical compartments 232 can have the same or similar characteristics as chemical compartments 132. Compartment openings 244 can have the same or similar characteristics as compartment openings 144.

Referring to FIG. 2B, spacer fluid 242 is injected into wellbore 202. Spacer fluid 242 can include the triggering media to dissolve window 240. Spacer fluid 242 can include the polymers used to react with chemical 246 within chemical compartments 232 to generate plug 250. Spacer fluid 242 can include the cross-linkers or activators used to react with the polymers in chemical 246 within chemical compartments 232 to generate plug 250.

Windows 240 are dissolved by the triggering media, the spacer fluid 242, wellbore fluid 208, or other means. Chemical 246 is released from chemical compartments 232 and enters wellbore 202. Chemical 246 can flow into target area 206 of formation 204. Chemical 246 can be an activator or a cross-linker. Chemical 246 can react with the polymer to form plug 250. The polymer can be in wellbore fluid 208, spacer fluid 242, or otherwise introduced into wellbore 202. Plug 250 is formed in target area 206. Plug 250 can form within formation 204 filling voids, fractures, and vugs. In some embodiments, plug 250 is not formed within wellbore 202 but only within the confines of formation 204. Plug 250 prevents fluid loss from target area 206.

Figure 3A:
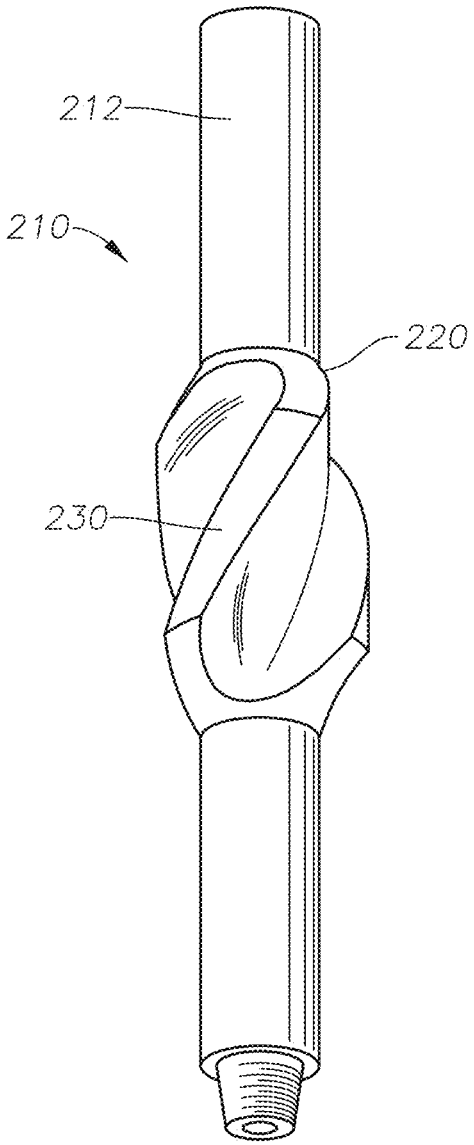
FIG. 3A is a depiction of a downhole drilling stabilizer, according to an embodiment.

Referring to FIG. 3A, drilling stabilizer 210 with a spiralized fin design is shown. Drilling stabilizer 210 features stabilizer body 220 and stabilizer teeth 230. Drilling stabilizer 210 is attached to drillstring assembly 212. Drilling stabilizer 210 can have the same or similar features as drilling stabilizer 110. Stabilizer body 220 can have the same or similar features as stabilizer body 120. Stabilizer teeth 230 can have the same or similar characteristics as stabilizer teeth 130. Stabilizer teeth 230 in this embodiment are depicted in a spiralized fashion, wrapping around stabilizer body 220.

Figure 3B:
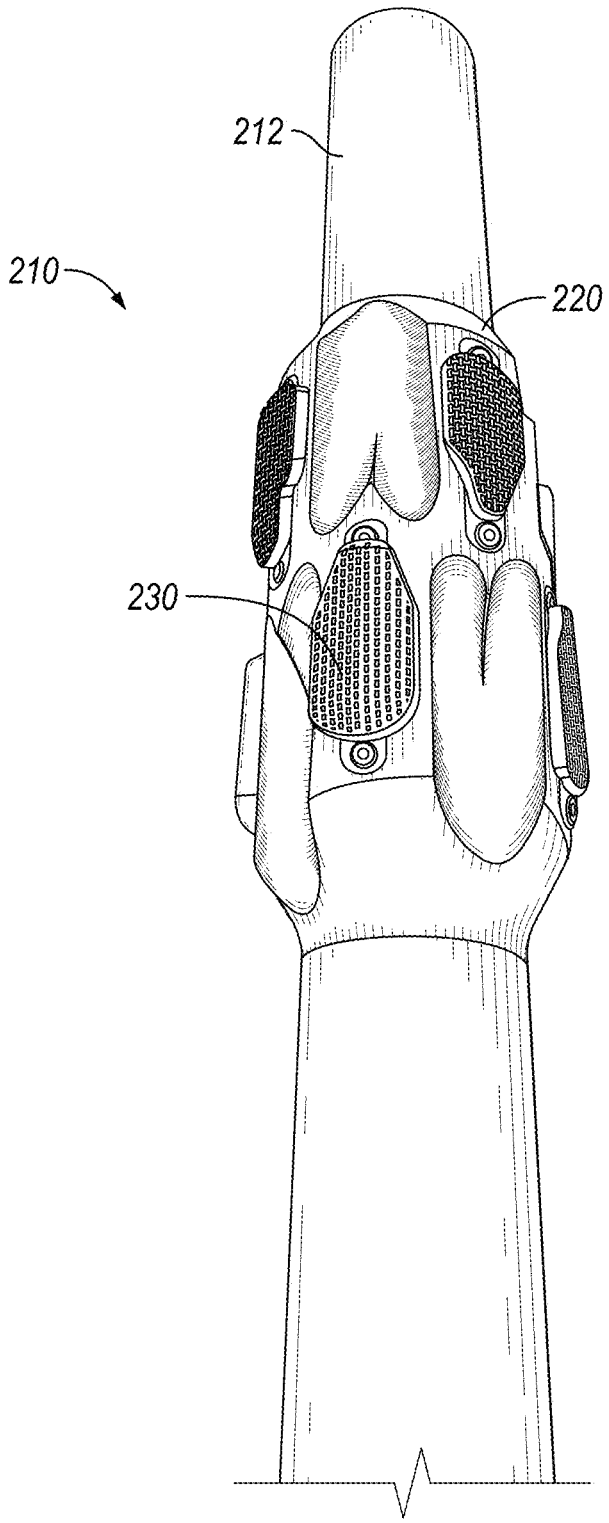
FIG. 3B is a depiction of a downhole drilling stabilizer, according to an embodiment.

Referring to FIG. 3B, drilling stabilizer 210 with an offset fin design is shown. Drilling stabilizer 210 features stabilizer body 220 and stabilizer teeth 230. Drilling stabilizer 210 is attached to drillstring assembly 212. Drilling stabilizer 210 can have the same or similar features as drilling stabilizer 110. Stabilizer body 220 can have the same or similar features as stabilizer body 120. Stabilizer teeth 230 can have the same or similar characteristics as stabilizer teeth 130. Stabilizer teeth 230 in this embodiment are depicted in an offset fashion, with stacked, shorter individual fins being offset from one another, placed around stabilizer body 220.

The singular forms "a," "an," and "the" include plural referents, unless the context clearly dictates otherwise.

As used in the specification and in the appended claims, the words "has," "contains," and "include" and all grammatical variations thereof are each intended to have an open, non-limiting meaning that does not exclude additional elements or steps.

What is claimed is:

1. A drilling stabilizer apparatus for use downhole, the drilling stabilizer apparatus comprising:

a stabilizer body;

stabilizer teeth protruding from the stabilizer body, at least one stabilizer tooth comprising a chemical compartment and a compartment opening, wherein the chemical compartment is operable to hold a chemical, and further wherein the compartment opening is an aperture operable to allow the chemicals to move into and out of the chemical compartment; and a window, the window overlaying the compartment opening, the window operable to temporarily seal the compartment opening such that the chemicals are prevented from being released from the chemical compartment, wherein the window comprises a dissolvable component.

2. The apparatus of claim 1, wherein the stabilizer teeth are hollow defining the chemical compartment.

3. The apparatus of claim 1, wherein the window comprises a dissolvable metal.

4. The apparatus of claim 3, wherein the dissolvable metal is selected from the group consisting of: a magnesium-based alloy, an aluminum-based alloy, and combinations of the same.

5. The apparatus of claim 1, wherein the window comprises a dissolvable polymer.

6. The apparatus of claim 5, wherein the dissolvable polymer is selected from the group consisting of: polyglycolic acid, polylactic acid, poly(lactide-co-glycolide) polymer, polyanhydride, poly(propylene fumarate), polycaprolactone, polyethylene glycol, polyurethane, and combinations of the same.

* * * * *